US007213306B2

(12) United States Patent
Medsker

(10) Patent No.: US 7,213,306 B2
(45) Date of Patent: May 8, 2007

(54) PULL TAB APPARATUS FOR SLIDE FASTENER

(76) Inventor: Thomas T. Medsker, 11 River Bluffs Dr., Fredericksburg, VA (US) 22407

( * ) Notice: Subject to any disclaimer, the term of this patent is extended or adjusted under 35 U.S.C. 154(b) by 22 days.

(21) Appl. No.: 11/056,613

(22) Filed: Feb. 11, 2005

(65) Prior Publication Data

US 2006/0179621 A1 Aug. 17, 2006

(51) Int. Cl.
*A44B 19/26* (2006.01)

(52) U.S. Cl. ..... 24/429; 24/431; 24/3.6; 24/3.12; 70/458; 70/456 B

(58) Field of Classification Search ..... 24/429, 24/431, 3.6, 3.12, DIG. 10; 59/85, 87; 70/458, 70/456 B See application file for complete search history.

(56) References Cited

U.S. PATENT DOCUMENTS 1,462,205 A * 7/1923 Korns ..... 70/458
1,488,383 A * 3/1924 Crow ..... 24/547
3,855,715 A * 12/1974 Johnson ..... 36/50.1
D271,214 S * 11/1983 Sato ..... D19/65
4,624,032 A 11/1986 Ishii et al.
4,928,358 A * 5/1990 Ishii et al. ..... 24/431
4,976,015 A 12/1990 Ishii
4,984,338 A 1/1991 Akashi
5,170,535 A * 12/1992 Strong ..... 24/67.9
5,347,692 A 9/1994 Ebata
5,722,277 A * 3/1998 Williams ..... 70/456 R
5,860,192 A 1/1999 Chung
6,035,497 A 3/2000 Jackson
6,240,604 B1 * 6/2001 Fox ..... 24/429
6,314,625 B1 11/2001 Ikeda
6,332,345 B1 * 12/2001 Huang ..... 70/456 R
6,560,829 B1 5/2003 Chen
6,581,254 B1 6/2003 Tang
D498,787 S * 11/2004 Nelms et al. ..... D19/9

* cited by examiner

*Primary Examiner*—Robert J. Sandy
*Assistant Examiner*—Marcus Menezes
(74) *Attorney, Agent, or Firm*—Jeffrey D. Carter

(57) ABSTRACT

A pull tab apparatus may be easily connected to and disconnected from a slide fastener by a user. The pull tab apparatus includes a coil having a first end and a second end. The coil includes a first section and a second section. At least one of the first and second sections includes a plurality of layers and a path exists between the layers. One of the first and second sections includes a circular portion and the other one of the first and second sections includes a plurality of parallel portions coupled to the circular portion. A circular disc is inserted into the circular portion. A portion of the slide fastener is movable along the path from one of the first and second ends where the pull tab apparatus is disconnected from the slide fastener to a predetermined position where the pull tab apparatus is connected to the slide fastener.

20 Claims, 8 Drawing Sheets

300

PULL TAB APPARATUS FOR SLIDE FASTENER

BACKGROUND OF THE INVENTION

1. Field of the Invention

The present invention generally relates to a pull tab apparatus, and more particularly, to a pull tab apparatus that may be easily connected to and disconnected from a slide fastener by a user.

2. Background Information

Slide fasteners often rely on a pull tab apparatus for effective operation. For example, a pull tab apparatus may be manipulated by a user to move a slide fastener such as a zipper in various directions. Pull tab apparatuses and slide fasteners may be used for various articles such as clothing garments, garment bags, backpacks, purses, luggage, camping equipment, vehicle/boat covers, and/or other articles.

With current pull tab apparatuses and slide fasteners, a problem arises when a pull tab apparatus breaks. In particular, when such breakage occurs, a user may be prevented from using the slide fastener. For example, certain slide fasteners such as zippers may include a locking mechanism in the zipper head that must be disengaged before the zipper can be moved in any direction. Accordingly, when a pull tab apparatus breaks with such a zipper, the locking mechanism may remain engaged and thereby prevent the zipper from being used. One solution to the foregoing problem is to replace the entire zipper head. While the cost of replacement parts with this approach may be relatively small, the labor costs can be cost-prohibitive for many users.

Accordingly, there is a need for a pull tab apparatus which avoids the foregoing deficiencies, and can thereby be easily connected to and disconnected from a slide fastener by a user. The present invention addresses these and/or other issues.

SUMMARY OF THE INVENTION

In accordance with an aspect of the present invention, a pull tab apparatus for a slide fastener is disclosed. According to an exemplary embodiment, the pull tab apparatus comprises a coil having a first end and a second end. The coil is configured to include a first section and a second section. At least one of the first and second sections includes a plurality of layers and a path exists between the layers. One of the first and second sections includes a circular portion and the other one of the first and second sections includes a plurality of parallel portions coupled to the circular portion. A circular disc is capable of being fixedly inserted into the circular portion. A portion of the slide fastener is movable along the path from one of the first and second ends where the pull tab apparatus is disconnected from the slide fastener to a predetermined position where the pull tab apparatus is connected to the slide fastener.

In accordance with another aspect of the present invention, an article of manufacture is disclosed. According to an exemplary embodiment, the article comprises a slide fastener and a pull tab apparatus capable of being connected to the slide fastener. The pull tab apparatus includes a coil having a first end and a second end. The coil is configured to include a first section and a second section. At least one of the first and second sections includes a plurality of layers and a path exists between the layers. One of the first and second sections includes a circular portion and the other one of the first and second sections includes a plurality of parallel portions coupled to the circular portion. A circular disc is capable of being fixedly inserted into the circular portion. A portion of the slide fastener is movable along the path from one of the first and second ends where the pull tab apparatus is disconnected from the slide fastener to a predetermined position where the pull tab apparatus is connected to the slide fastener.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

Figure 1:
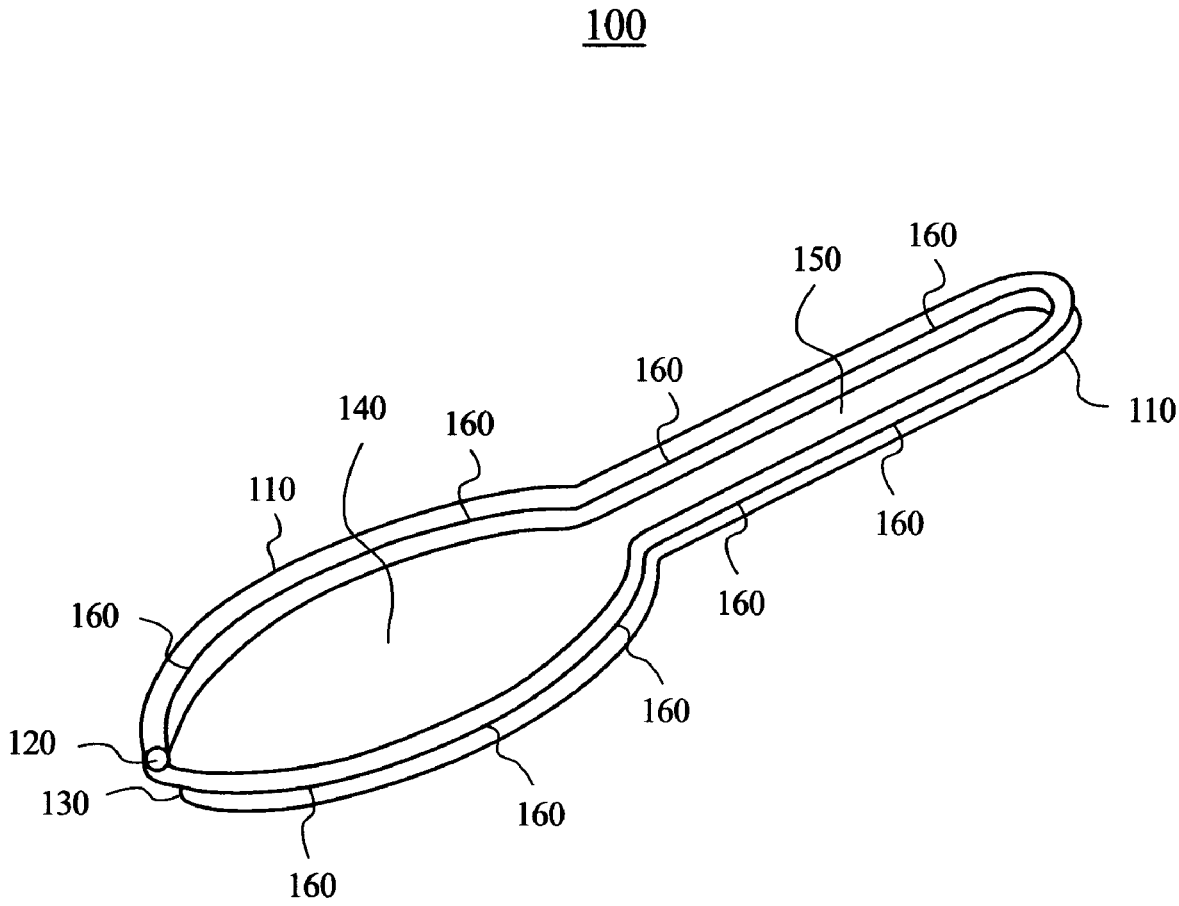
FIG. 1 is a perspective view of a pull tab apparatus according to a first exemplary embodiment of the present invention.
Figure 3:
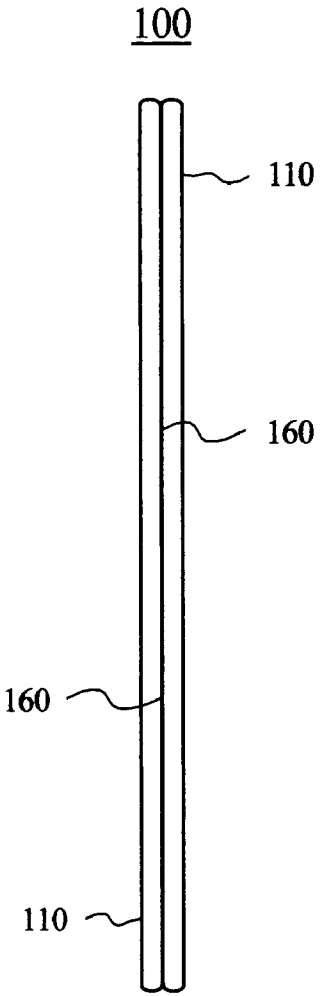
FIG. 3 is a side view of the pull tab apparatus of FIG. 1 according to an exemplary embodiment of the present invention.
Figure 2:
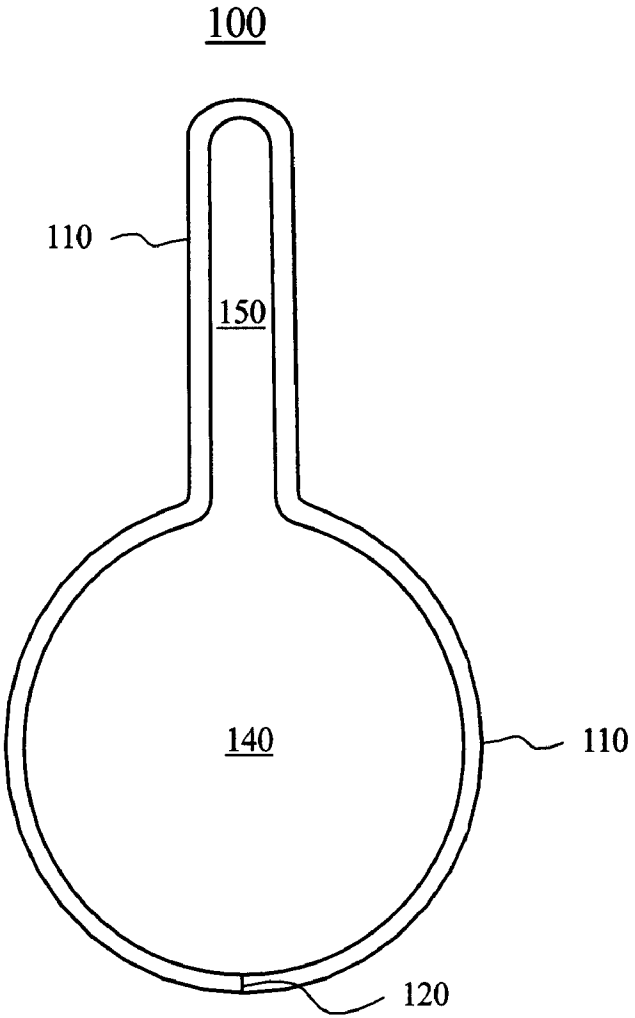
FIG. 2 is a plan view of the pull tab apparatus of FIG. 1 according to an exemplary embodiment of the present invention.

Referring now to the drawings, and more particularly to FIG. 1, a perspective view of a pull tab apparatus 100 according to a first exemplary embodiment of the present invention is shown. An exemplary plan view of pull tab apparatus 100 is shown in FIG. 2, and an exemplary (right and left) side view of pull tab apparatus 100 is shown in FIG. 3. Pull tab apparatus 100 of FIGS. 1 to 3 comprises a coil 110 having a first end 120 and a second end 130. Coil 110 may be constructed using any material of suitable strength to enable use of pull tab apparatus 100 with a slide fastener such as a zipper. For example, coil 110 may be constructed using a metallic, polymeric, and/or other material. Coil 110 may also include a coating (not expressly shown in FIGS.) such as a vinyl and/or other type of coating. The body of coil 110 may be formed in any suitable shape such as a columnar and/or cylindrical shape.

Coil 110 is configured (e.g., wound) to include a first section 140 exhibiting a first shape and a second section 150 exhibiting a second shape. According to an exemplary embodiment, first section 140 generally exhibits a circular shape (or at least a portion of a circle), and second section 150 generally exhibits an oblong, elongated shape. However, first and second sections 140 and 150 of coil 110 may exhibit other shapes, and the specific shape used for each section 140 and 150 is a matter of design choice. Also according to an exemplary embodiment, first and second sections 140 and 150 of coil 110 both include a plurality of layers that contact each other or are substantially close to each other. As indicated in FIGS. 1 and 3, first and second sections 140 and 150 of coil 110 both include two layers, although a different number of layers may also be used in accordance with design choice. According to an exemplary embodiment, a portion of coil 110 between first and second ends 120 and 130 is curved so that first and second ends 120 and 130 lie in substantially the same plane, as represented in FIG. 3. However, this portion of coil 110 between first and second ends 120 and 130 could also be substantially straight so that first and second ends 120 and 130 of coil 110 lie in different planes.

A path 160 exists between the layers of coil 110. According to an exemplary embodiment, a user may insert a latch portion of a slide fastener (not shown in FIGS. 1 to 3) into path 160 at either first end 120 or second end 130 of coil 110. The user may then manipulate the slide fastener and/or pull tab apparatus 100 to move the inserted latch portion of the slide fastener along path 160 from one end (e.g., first end 120) of coil 110 where pull tab apparatus 100 is disconnected from the slide fastener to the other end (e.g., second end 130) of coil 110 where pull tab apparatus 100 is connected to the slide fastener. The reverse operation may be performed to disconnect pull tab apparatus 100 from the slide fastener. As previously indicated herein, the respective layers of coil 110 may contact each other or be substantially close to each other. Accordingly, as the latch portion of the slide fastener is moved along path 160 to connect or disconnect pull tab apparatus 100 to or from the slide fastener, the respective layers of coil 110 may become separated from each other and thereby displaced from their original orientation (represented in FIG. 1) to accommodate passage of the latch portion along path 160. In the aforementioned manner, pull tab apparatus 100 may be easily connected to and disconnected from a slide fastener.

Figure 4:
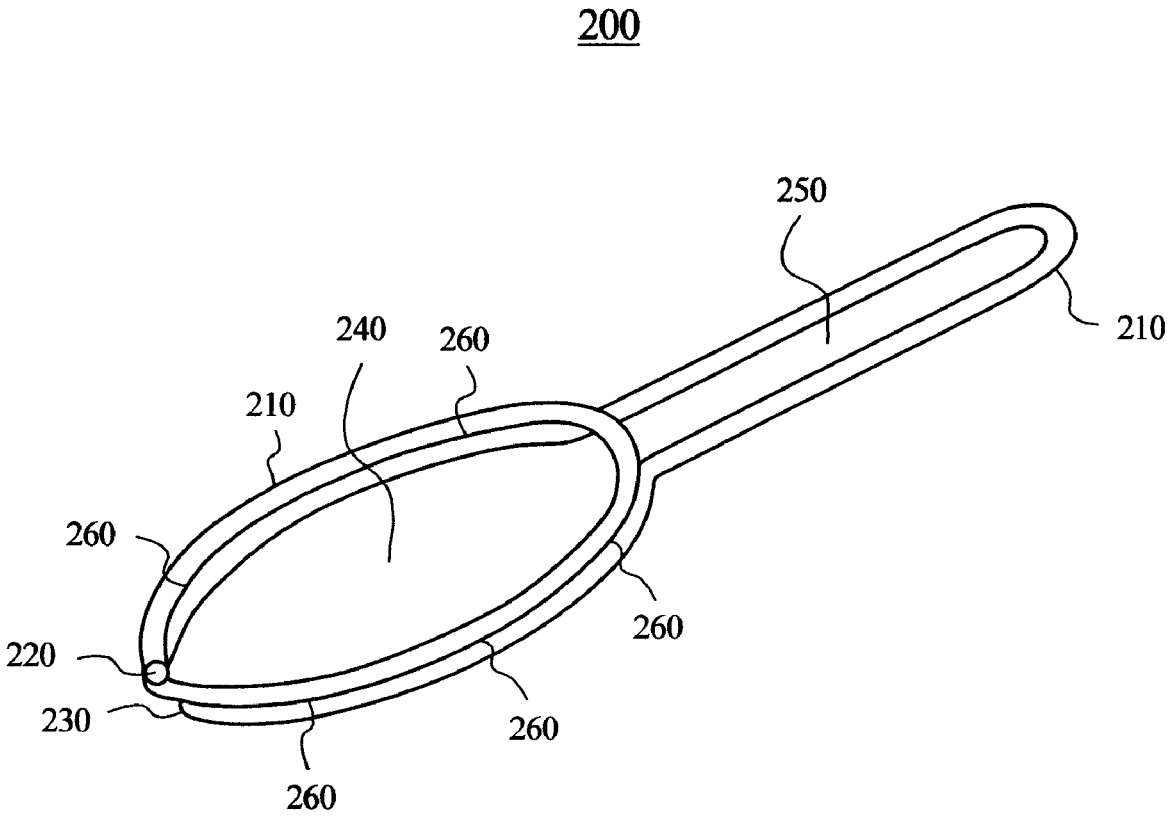
FIG. 4 is a perspective view of a pull tab apparatus according to a second exemplary embodiment of the present invention.
Figure 6:
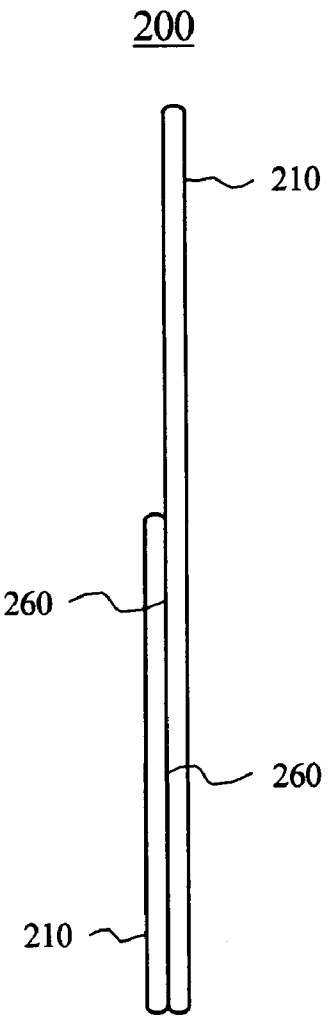
FIG. 6 is a side view of the pull tab apparatus of FIG. 4 according to an exemplary embodiment of the present invention.
Figure 5:
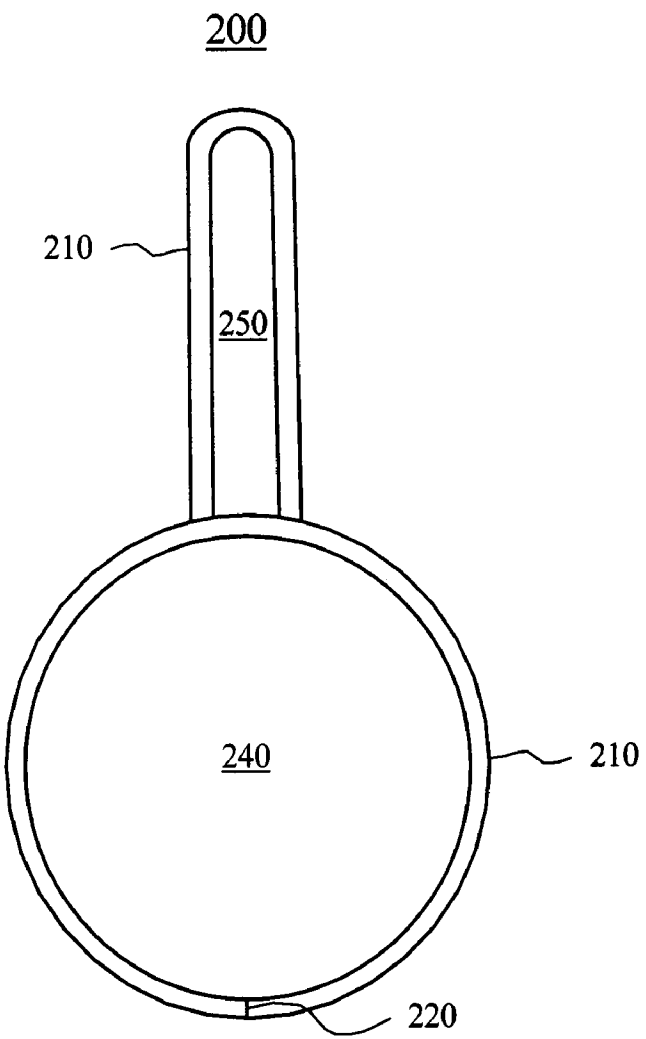
FIG. 5 is a plan view of the pull tab apparatus of FIG. 4 according to an exemplary embodiment of the present invention.

Referring to FIG. 4, a perspective view of a pull tab apparatus 200 according to a second exemplary embodiment of the present invention is shown. An exemplary plan view of pull tab apparatus 200 is shown in FIG. 5, and an exemplary (right) side view of pull tab apparatus 200 is shown in FIG. 6. Pull tab apparatus 200 of FIGS. 4 to 6 comprises a coil 210 having a first end 220 and a second end 230. Like coil 110 of FIGS. 1 to 3, coil 210 may also be constructed using any material of suitable strength to enable use of pull tab apparatus 200 with a slide fastener such as a zipper. For example, coil 210 may be constructed using a metallic, polymeric, and/or other material. Coil 210 may also include a coating (not expressly shown in FIGS.) such as a vinyl and/or other type of coating. The body of coil 210 may be formed in any suitable shape such as a columnar and/or cylindrical shape.

Coil 210 is configured (e.g., wound) to include a first section 240 exhibiting a first shape and a second section 250 exhibiting a second shape. According to an exemplary embodiment, first section 240 generally exhibits a circular shape (or at least a portion of a circle), and second section 250 generally exhibits an oblong, elongated shape. However, first and second sections 240 and 250 of coil 210 may exhibit other shapes, and the specific shape used for each section 240 and 250 is a matter of design choice. Also according to an exemplary embodiment, first section 240 of coil 210 includes a plurality of layers that contact each other or are substantially close to each other, and second section 250 of coil 210 includes a single layer. As indicated in FIGS. 4 and 6, first section 240 of coil 210 includes two layers, and second section 250 of coil 210 includes only a single layer, although a different number of layers may also be used in accordance with design choice. According to an exemplary embodiment, a portion of coil 210 between first and second ends 220 and 230 is curved so that first and second ends 220 and 230 lie in substantially the same plane, as represented in FIG. 6. However, this portion of coil 210 between first and second ends 220 and 230 could also be substantially straight so that first and second ends 220 and 230 of coil 210 lie in different planes.

A path 260 exists between the layers of coil 210 in first section 240. According to an exemplary embodiment, a user may insert a latch portion of a slide fastener (not shown in FIGS. 4 to 6) into path 260 at first end 220 of coil 210. The user may then manipulate the slide fastener and/or pull tab apparatus 200 to move the inserted latch portion of the slide fastener along path 260 from first end 220 of coil 210 where pull tab apparatus 200 is disconnected from the slide fastener to second end 230 of coil 210 where pull tab apparatus 200 is connected to the slide fastener via first section 240 of coil 210. The reverse operation may be performed to disconnect pull tab apparatus 200 from the slide fastener. According to another exemplary embodiment, a user may insert a latch portion of a slide fastener (not shown in FIGS. 4 to 6) into path 260 at second end 230 of coil 210. The user may then manipulate the slide fastener and/or pull tab apparatus 200 to move the inserted latch portion of the slide fastener along path 260 from second end 230 of coil 210 where pull tab apparatus 200 is disconnected from the slide fastener to a predetermined point within second section 250 of coil 210 where pull tab apparatus 200 is connected to the slide fastener via second section 250 of coil 210. The reverse operation may be performed to disconnect pull tab apparatus 200 from the slide fastener. As previously indicated herein, the respective layers of coil 210 in first section 240 may contact each other or be substantially close to each other. Accordingly, with both exemplary embodiments, as the latch portion of the slide fastener is moved along path 260 to connect or disconnect pull tab apparatus 200 to or from the slide fastener, the respective layers of coil 210 in first section 240 may become separated from each other and thereby displaced from their original orientation (represented in FIG. 4) to accommodate passage of the latch portion along path 260. In the aforementioned manner, pull tab apparatus 200 may be easily connected to and disconnected from a slide fastener via first and second sections 240 and 250 of coil 210.

Figure 7:
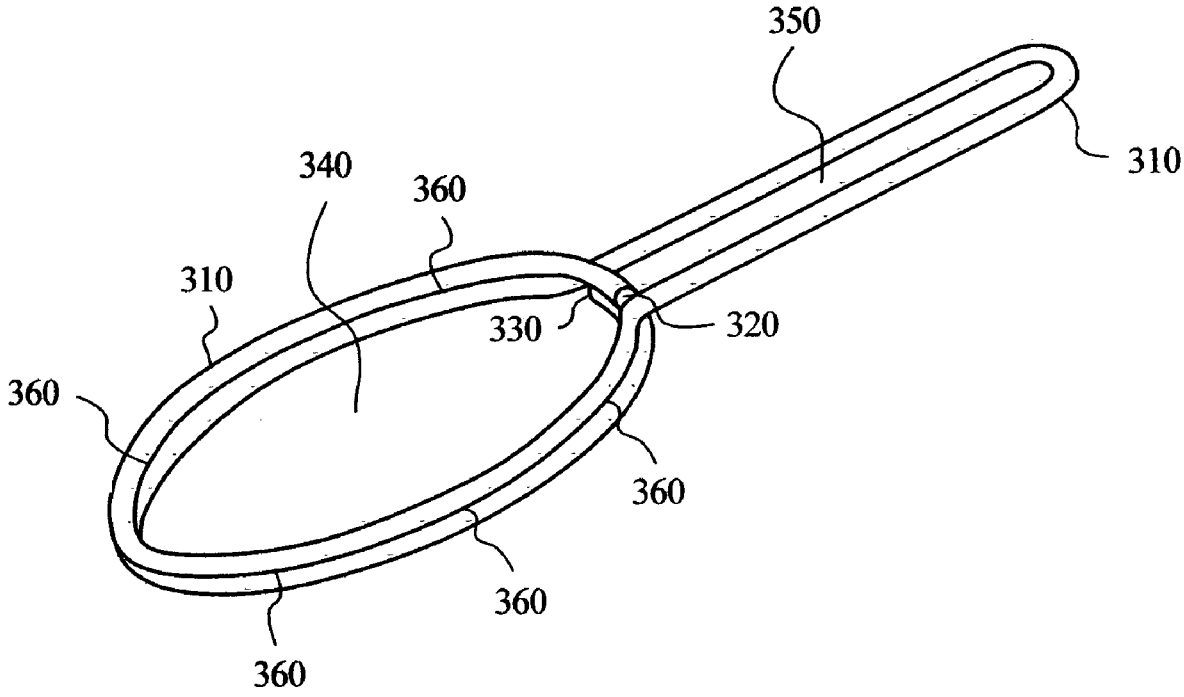
FIG. 7 is a perspective view of a pull tab apparatus according to a third exemplary embodiment of the present invention.
Figure 9:
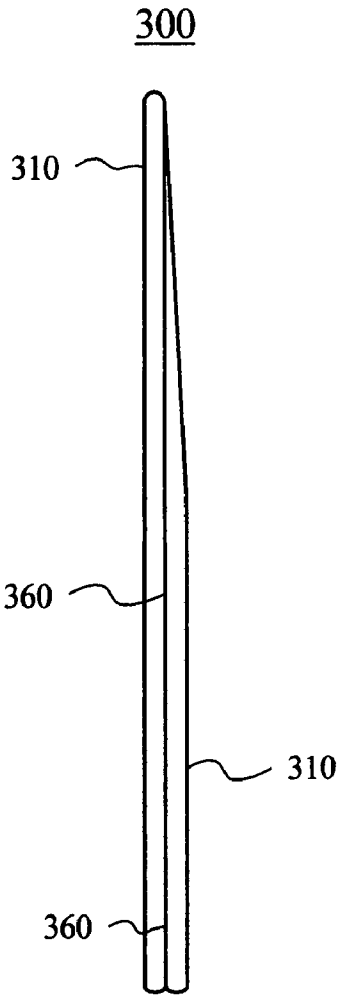
FIG. 9 is a side view of the pull tab apparatus of FIG. 7 according to an exemplary embodiment of the present invention.
Figure 8:
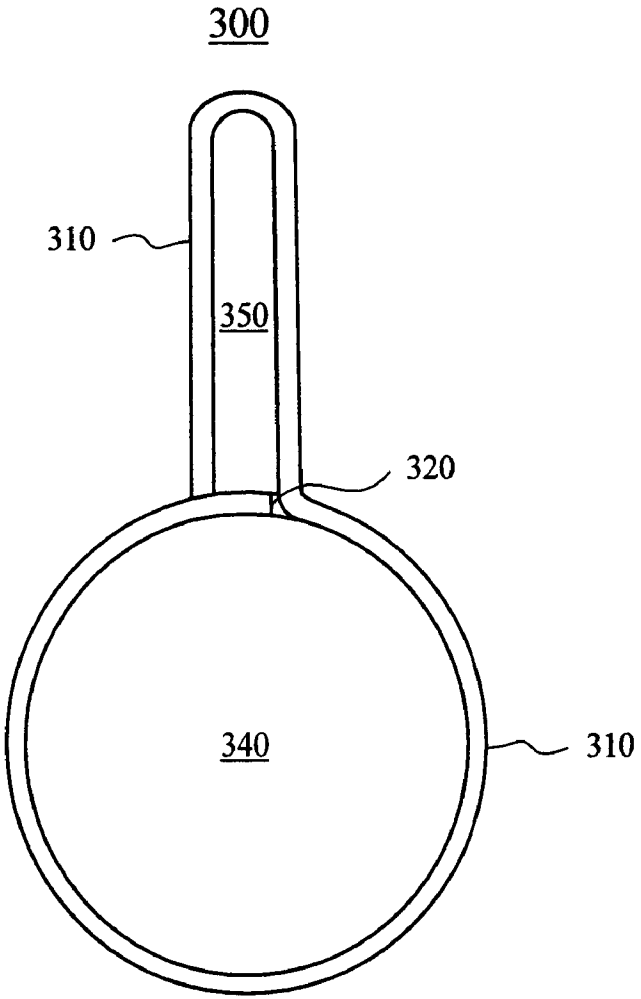
FIG. 8 is a plan view of the pull tab apparatus of FIG. 7 according to an exemplary embodiment of the present invention.

Referring to FIG. 7, a perspective view of a pull tab apparatus 300 according to a third exemplary embodiment of the present invention is shown. An exemplary plan view of pull tab apparatus 300 is shown in FIG. 8, and an exemplary (right) side view of pull tab apparatus 300 is shown in FIG. 9. Pull tab apparatus 300 of FIGS. 7 to 9 comprises a coil 310 having a first end 320 and a second end 330. Like coils 110 and 210 previously described herein, coil 310 may also be constructed using any material of suitable strength to enable use of pull tab apparatus 300 with a slide fastener such as a zipper. For example, coil 310 may be constructed using a metallic, polymeric, and/or other material. Coil 310 may also include a coating (not expressly shown in FIGS.) such as a vinyl and/or other type of coating. The body of coil 310 may be formed in any suitable shape such as a columnar and/or cylindrical shape.

Coil 310 is configured (e.g., wound) to include a first section 340 exhibiting a first shape and a second section 350 exhibiting a second shape. According to an exemplary embodiment, first section 340 generally exhibits a circular shape (or at least a portion of a circle), and second section 350 generally exhibits an oblong, elongated shape. However, first and second sections 340 and 350 of coil 310 may exhibit other shapes, and the specific shape used for each section 340 and 350 is a matter of design choice. Also according to an exemplary embodiment, first section 340 of coil 310 includes a plurality of layers that contact each other or are substantially close to each other, and second section 350 of coil 310 includes a single layer. As indicated in FIGS. 7 and 9, first section 340 of coil 310 includes two layers, and second section 350 of coil 310 includes only a single layer, although a different number of layers may also be used in accordance with design choice.

A path 360 exists between the layers of coil 310 in first section 340. According to an exemplary embodiment, a user may insert a latch portion of a slide fastener (not shown in FIGS. 7 to 9) into path 360 at either first end 320 or second end 330 of coil 310. The user may then manipulate the slide fastener and/or pull tab apparatus 300 to move the inserted latch portion of the slide fastener along path 360 from one end (e.g., first end 320) of coil 310 where pull tab apparatus 300 is disconnected from the slide fastener to a predetermined point within second section 350 of coil 310 where pull tab apparatus 300 is connected to the slide fastener via second section 350 of coil 310. The reverse operation may be performed to disconnect pull tab apparatus 300 from the slide fastener. As previously indicated herein, the respective layers of coil 310 in first section 340 may contact each other or be substantially close to each other. Accordingly, as the latch portion of the slide fastener is moved along path 360 to connect or disconnect pull tab apparatus 300 to or from the slide fastener, the respective layers of coil 310 in first section 340 may become separated from each other and thereby displaced from their original orientation (represented in FIG. 7) to accommodate passage of the latch portion along path 360. In the aforementioned manner, pull tab apparatus 300 may be easily connected to and disconnected from a slide fastener.

Figure 11:
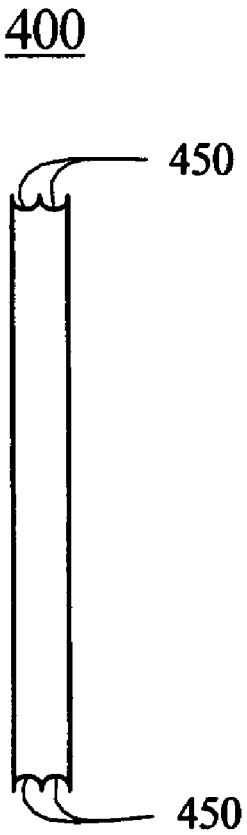
FIG. 11 is a side view of the disc element of FIG. 10 according to an exemplary embodiment of the present invention.
Figure 10:
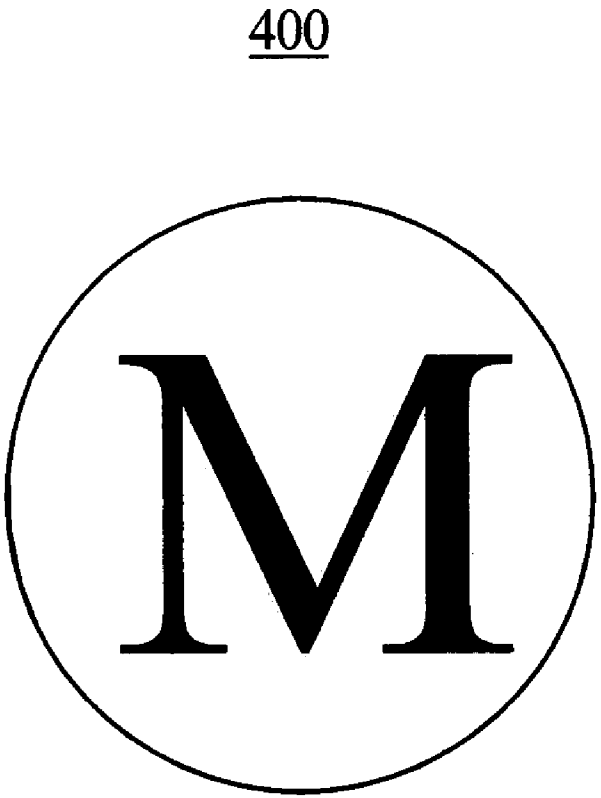
FIG. 10 is plan view of a disc element according to an exemplary embodiment of the present invention.
Figure 12:
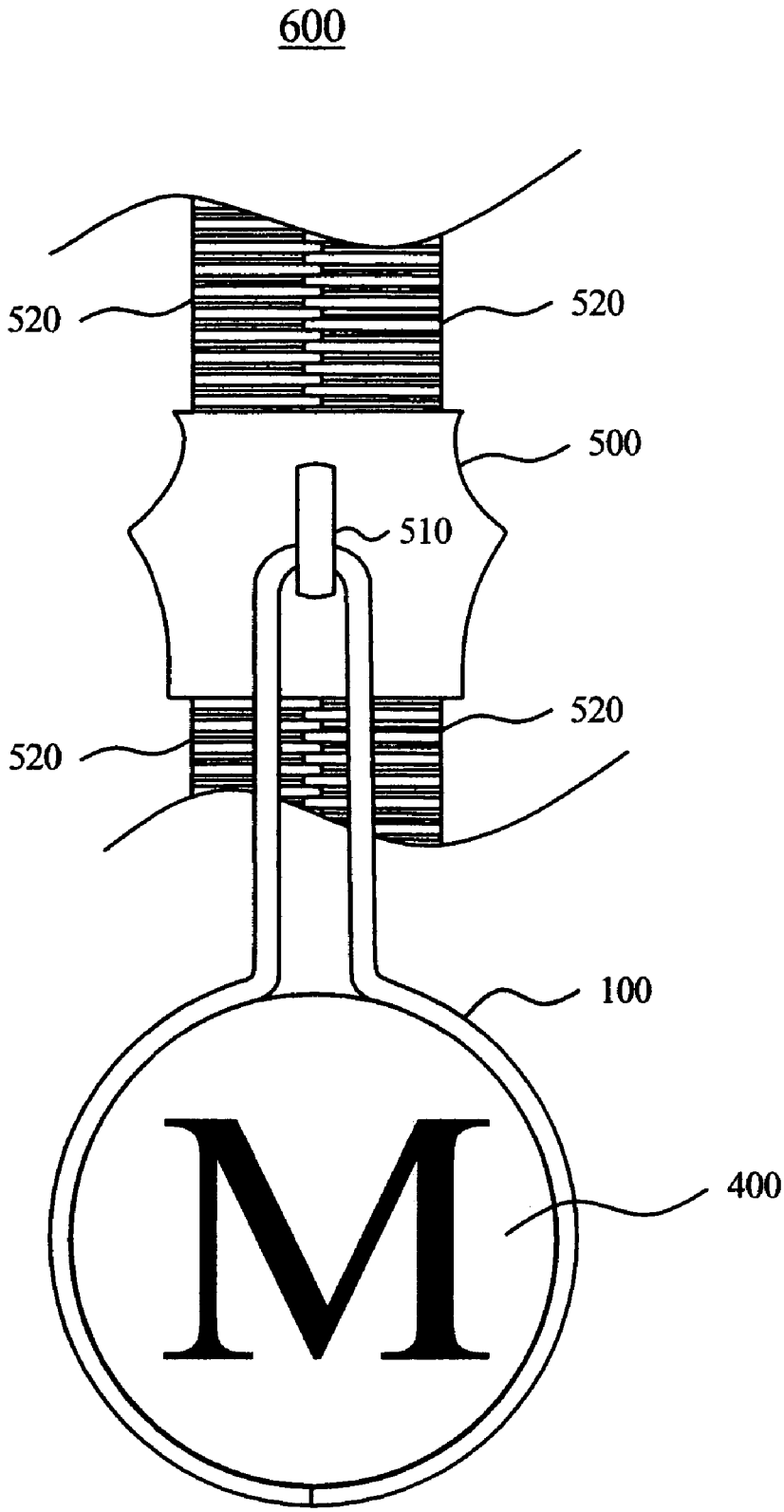
FIG. 12 is an article of manufacture according to an exemplary embodiment of the present invention.

Referring to FIG. 10, a plan view of a disc element 400 according to an exemplary embodiment of the present invention is shown. An exemplary (right and left) side view of disc element 400 is shown in FIG. 11. According to an exemplary embodiment, disc element 400 may be combined with pull tab apparatuses 100, 200 and/or 300 as previously described herein. As indicated in FIG. 11, recesses 450 are formed in an outer periphery of disc element 400 and thereby enable disc element 400 to be fixedly inserted (e.g., "snap fit") into at least one section of coil 110, 210 and/or 310. The number of recesses 450 formed in disc element 400 preferably corresponds to the number of layers in the section(s) of coil 110, 210 and/or 310 that disc element 400 is inserted. According to an exemplary embodiment, disc element 400 includes two recesses 450 in its outer periphery and may be fixedly inserted into first sections 140, 240 and/or 340 of pull tab apparatuses 100, 200 and/or 300, respectively. FIG. 12 shows an example of how disc element 400 may be combined with pull tab apparatus 100.

Also according to an exemplary embodiment, disc element 400 may be constructed using a metallic, polymeric, and/or other material. Disc element 400 may also be produced in various colors. For example, disc element 400 may exhibit a color that blends and/or contrasts with the surrounding materials. Disc element 400 may also include a custom logo, emblem, symbol, writing, decal, and/or other visually observable item. For example, disc element 400 may include the name of a sports team, pet, school, mascot, alma matter, and/or other item. For purposes of example and explanation, disc element 400 of FIGS. 10 and 12 includes the initial "M".

Referring now to FIG. 12, an article of manufacture 600 according to an exemplary embodiment of the present invention is shown. Article 600 may, for example, be embodied as a clothing garment, garment bag, backpack, purse, luggage, camping equipment, vehicle/boat cover, and/or other article. Article 600 of FIG. 12 includes pull tab apparatus 100 of FIGS. 1 to 3, disc element 400 of FIGS. 10 and 11, and a slide fastener 500 embodied as a zipper having a latch portion 510 and teeth 520. As shown in FIG. 12, pull tab apparatus 100 may be connected to (and disconnected from) slide fastener 500 via latch portion 510 in the manner previously described herein. Moreover, disc element 400 may be fixedly inserted into one or more sections of pull tab apparatus 100. Pull tab apparatuses 200 and 300, as described herein, may also be combined with disc element 400 and/or slide fastener 500 in a similar manner.

As described herein, the present invention provides a pull tab apparatus that may be easily connected to and disconnected from a slide fastener by a user. While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pull tab apparatus for a slide fastener, comprising:

a coil having a first end and a second end and being configured to include a first section exhibiting a first shape and a second section exhibiting a second shape;

wherein one of said first and second sections includes a circular portion and the other one of said first and second sections includes a plurality of parallel portions coupled to said circular portion, and a circular disc is inserted into said circular portion;

wherein at least one of said first and second sections includes a plurality of layers and a path exists between said plurality of layers; and wherein a portion of said slide fastener is movable along said path from one of said first and second ends where said pull tab apparatus is disconnected from said slide fastener to a predetermined position where said pull tab apparatus is connected to said slide fastener.

2. The pull tab apparatus of claim 1, wherein said first and second sections both include said plurality of layers and said predetermined position is located at one of said first and second ends.

3. The pull tab apparatus of claim 1, wherein said portion of said slide fastener is further movable along said path from said predetermined position where said pull tab apparatus is connected to said slide fastener to one of said first and second ends where said pull tab apparatus is disconnected from said slide fastener.

4. The pull tab apparatus of claim 3, wherein said plurality of layers are displaced from a first orientation while said portion of said slide fastener is moved along said path.

5. The pull tab apparatus of claim 1, wherein said slide fastener is a zipper.

6. The pull tab apparatus of claim 1, wherein one of said first and second sections includes said plurality of layers and the other one of said first and second sections includes a single layer, and further wherein said predetermined position is located before one of said first and second ends.

7. The pull tab apparatus of claim 1, wherein said first and second ends both exist within one of said first and second sections.

8. An article, comprising:

a slide fastener;

a pull tab apparatus including a coil having a first end and a second end and being configured to include a first section exhibiting a first shape and a second section exhibiting a second shape;

wherein one of said first and second sections includes a circular portion and the other one of said first and second sections includes a plurality of parallel portions coupled to said circular portion, and a circular disc is inserted into said circular portion;

wherein at least one of said first and second sections includes a plurality of layers and a path exists between said plurality of layers; and wherein a portion of said slide fastener is movable along said path from one of said first and second ends where said pull tab apparatus is disconnected from said slide fastener to a predetermined position where said pull tab apparatus is connected to said slide fastener.

9. The article of claim 8, wherein said first and second sections both include said plurality of layers and said predetermined position is located at one of said first and second ends.

10. The article of claim 8, wherein said portion of said slide fastener is further movable along said path from said predetermined position where said pull tab apparatus is connected to said slide fastener to one of said first and second ends where said pull tab apparatus is disconnected from said slide fastener.

11. The article of claim 10, wherein said plurality of layers are displaced from a first orientation while said portion of said slide fastener is moved along said path.

12. The article of claim 8, wherein said slide fastener is a zipper.

13. The article of claim 8, wherein one of said first and second sections includes said plurality of layers and the other one of said first and second sections includes a single layer, and further wherein said predetermined position is located before one of said first and second ends.

14. The article of claim 8, wherein said first and second ends both exist within one of said first and second sections.

15. An article, comprising:

a slide fastener;

a circular disc;

a pull tab apparatus comprising a coil having a first end and a second end and being configured to include a first section and a second section;

wherein one of said first and second sections includes a circular portion and the other one of said first and second sections includes a plurality of parallel portions coupled to said circular portion;

wherein said circular disc is fixedly inserted into said circular portion;

wherein at least one of said first and second sections includes a plurality of layers and a path exists between said plurality of layers; and wherein a portion of said slide fastener is movable along said path from one of said first and second ends where said pull tab apparatus is disconnected from said slide fastener to a predetermined position where said pull tab apparatus is connected to said slide fastener.

16. The article of claim 15, wherein said first and second sections both include said plurality of layers and said predetermined position is located at one of said first and second ends.

17. The article of claim 15, wherein said portion of said slide fastener is further movable along said path from said predetermined position where said pull tab apparatus is connected to said slide fastener to one of said first and second ends where said pull tab apparatus is disconnected from said slide fastener.

18. The article of claim 17, wherein said plurality of layers are displaced from a first orientation while said portion of said slide fastener is moved along said path.

19. The article of claim 15, wherein said slide fastener is a zipper.

20. The article of claim 15, wherein said first and second ends both exist within one of said first and second sections.

* * * * *